US010571187B2

(12) United States Patent
Lourenco et al.

(10) Patent No.: US 10,571,187 B2
(45) Date of Patent: Feb. 25, 2020

(54) TEMPERATURE CONTROLLED METHOD TO LIQUEFY GAS AND A PRODUCTION PLANT USING THE METHOD

(71) Applicants: 1304338 Alberta Ltd, Edmonton (CA); 1304342 Alberta Ltd, Edmonton (CA)

(72) Inventors: Jose Lourenco, Edmonton (CA); MacKenzie Millar, Edmonton (CA)

(73) Assignees: 1304338 Alberta Ltd, Edmonton (CA); 1304342 Alberta Ltd, Edmonton (CA)

( * ) Notice: Subject to any disclaimer, the term of this patent is extended or adjusted under 35 U.S.C. 154(b) by 104 days.

(21) Appl. No.: 14/386,323

(22) PCT Filed: Mar. 21, 2013

(86) PCT No.: PCT/CA2013/050232
§ 371 (c)(1),
(2) Date: Sep. 18, 2014

(87) PCT Pub. No.: WO2013/138940
PCT Pub. Date: Sep. 26, 2013

(65) Prior Publication Data

US 2015/0107297 A1 Apr. 23, 2015

(30) Foreign Application Priority Data

Mar. 21, 2012 (CA) ..... 2772479

(51) Int. Cl.
*F25J 1/00* (2006.01)
*F25J 1/02* (2006.01)

(52) U.S. Cl.
CPC ..... *F25J 1/0022* (2013.01); *F25J 1/004* (2013.01); *F25J 1/0035* (2013.01); *F25J 1/0045* (2013.01);
(Continued)

(58) Field of Classification Search
CPC ..... F25J 1/0022; F25J 1/0035; F25J 1/004; F25J 1/0045; F25J 1/0202; F25J 2220/64;
(Continued)

(56) References Cited

U.S. PATENT DOCUMENTS 2,168,438 A 8/1939 Carrier
3,002,362 A 10/1961 Morrison
(Continued)

FOREIGN PATENT DOCUMENTS

CA 1048876 A 2/1979
CA 2 422 893 A1 2/2002
(Continued)

OTHER PUBLICATIONS

International Search Report and Written Opinion dated Aug. 1, 2013, issued in corresponding International Application No. PCT/CA2013/050232, filed Mar. 21, 2013, 13 pages.
(Continued)

*Primary Examiner* — Keith M Raymond
(74) *Attorney, Agent, or Firm* — Christensen O'Connor Johnson Kindness, PLLC

(57) ABSTRACT

A method for liquefying gas involving pre-treating the gas stream in a pre-treater to remove impurities, and then passing the gas stream through a first flow path of a first heat exchanger to lower a temperature of the gas stream. The gas stream is then passed through the gas expansion turbine to lower a pressure of the gas stream and further decrease the temperature of the gas stream. The gas stream is then passed into a primary separator to separate the gas stream into a liquid stream and a cold gas stream. The liquid stream is collected. Selected quantities of the cold gas stream are passed through a second flow path of the first heat exchanger whereby a heat exchange takes place to cool the gas stream flowing through the first flow path to maintain the tempera-
(Continued)

ture of the gas stream entering the gas expansion turbine at a temperature which promotes the production of liquids.

2 Claims, 3 Drawing Sheets

(52) U.S. Cl.
CPC ..... *F25J 1/0047* (2013.01); *F25J 1/0202* (2013.01); *F25J 1/0232* (2013.01); *F25J 2205/02* (2013.01); *F25J 2220/00* (2013.01); *F25J 2220/64* (2013.01); *F25J 2245/02* (2013.01)

(58) Field of Classification Search
CPC ... F25J 2220/66; F25J 2220/68; F25J 2245/02
See application file for complete search history.

(56) References Cited

U.S. PATENT DOCUMENTS 3,152,194 A 10/1964 Pohl et al.
3,184,926 A 5/1965 Blake
3,280,575 A 10/1966 Drake
3,312,073 A * 4/1967 Jackson et al. ..... F25J 1/0022 62/54.1
3,367,122 A 2/1968 Tutton
3,653,220 A 4/1972 Foster et al.
3,735,600 A 5/1973 Dowdell et al.
3,747,359 A 7/1973 Streich
3,754,405 A 8/1973 Rosen
3,792,590 A 2/1974 Lofredo et al.
3,846,993 A 11/1974 Bates
3,859,811 A 1/1975 Duncan
3,919,853 A 11/1975 Rojey
3,962,881 A 6/1976 Muska
4,033,735 A 7/1977 Swenson
4,279,130 A 7/1981 Finch et al.
4,418,530 A 12/1983 Bodrov et al.
4,424,680 A 1/1984 Rothchild
4,430,103 A 2/1984 Gray et al.
4,444,577 A 4/1984 Perez
4,617,039 A 10/1986 Buck
4,681,612 A 7/1987 O'Brien et al.
4,710,214 A 12/1987 Sharma et al.
4,751,151 A 6/1988 Healy et al.
4,869,740 A 9/1989 Campbell et al.
4,907,405 A 3/1990 Polizzotto
4,936,888 A 6/1990 DeLong
5,137,558 A 8/1992 Agrawal
5,295,350 A 3/1994 Child et al.
5,329,774 A 7/1994 Tanguay et al.
5,425,230 A 6/1995 Shpak
5,440,894 A 8/1995 Schaeffer et al.
5,669,234 A * 9/1997 Houser ..... F25J 1/0022 62/612
5,678,411 A 10/1997 Matsumura et al.
5,685,170 A 11/1997 Sorensen
5,782,958 A 7/1998 Rojey et al.
5,799,505 A 9/1998 Bonaquist et al.
5,953,935 A 9/1999 Sorensen
6,023,942 A * 2/2000 Thomas ..... B23K 9/173 62/613
6,089,022 A 7/2000 Zednik et al.
6,089,028 A 7/2000 Bowen et al.
6,131,407 A 10/2000 Wissolik
6,138,473 A 10/2000 Boyer-Vidal
6,182,469 B1 2/2001 Campbell et al.
6,196,021 B1 * 3/2001 Wissolik ..... F25J 1/0012 62/606
6,266,968 B1 7/2001 Redlich
6,286,315 B1 9/2001 Staehle
6,378,330 B1 4/2002 Minta et al.
6,432,565 B1 8/2002 Haines
6,517,286 B1 2/2003 Latchem
6,526,777 B1 3/2003 Campbell et al.
6,581,409 B2 6/2003 Wilding et al.
6,606,860 B2 8/2003 McFarland
6,640,555 B2 11/2003 Cashin
6,662,589 B1 12/2003 Roberts et al.
6,694,774 B1 2/2004 Rashad et al.
6,739,140 B2 5/2004 Bishop et al.
6,751,985 B2 * 6/2004 Kimble ..... F25J 1/0022 62/613
6,889,523 B2 * 5/2005 Wilkinson ..... F25J 1/0201 62/613
6,932,121 B1 8/2005 Shivers, III
6,945,049 B2 9/2005 Madsen
7,051,553 B2 5/2006 Mak et al.
7,107,788 B2 9/2006 Patel et al.
7,155,917 B2 1/2007 Baudat
7,219,502 B2 5/2007 Nierenberg
7,257,966 B2 8/2007 Lee et al.
7,377,127 B2 5/2008 Mak
8,899,074 B2 * 12/2014 Wilding ..... F25J 1/0022 62/532
2002/0170297 A1 11/2002 Quine et al.
2003/0008605 A1 1/2003 Hartford, Jr. et al.
2003/0019219 A1 1/2003 Viegas et al.
2003/0051875 A1 3/2003 Wilson
2003/0182947 A1 10/2003 Kimble et al.
2003/0196452 A1 10/2003 Wilding et al.
2004/0065085 A1 4/2004 Madsen
2005/0086974 A1 4/2005 Steinbach et al.
2005/0244277 A1 11/2005 Hurst, Jr. et al.
2006/0213222 A1 9/2006 Whitesell
2006/0213223 A1 9/2006 Wilding et al.
2006/0242970 A1 11/2006 Yang et al.
2007/0062216 A1 3/2007 Mak et al.
2007/0107465 A1 5/2007 Turner et al.
2008/0016910 A1 1/2008 Brostow et al.
2009/0113928 A1 5/2009 Vandor et al.
2009/0249829 A1 10/2009 Lourenco et al.
2009/0282865 A1 11/2009 Martinez et al.
2011/0094263 A1 4/2011 Wilding et al.
2012/0060554 A1 3/2012 Schmidt
2012/0169049 A1 7/2012 Oxner et al.
2013/0333416 A1 12/2013 Lourenco et al.

FOREIGN PATENT DOCUMENTS

CA 2 467 338 A1 7/2003
CA 2 516 785 A1 9/2004
CA 2 552 366 A1 7/2005
CA 2 299 695 A1 7/2007
CA 2 318 802 A1 2/2008
CA 2 777 760 A1 5/2011
CA 2 728 716 A1 7/2012
CA 2 515 999 A1 12/2012
CN 1615415 A 5/2005
CN 1019448706 A 1/2011
DE 44 16 359 A1 10/1998
EP 0 482 222 A1 4/1992
EP 0 566 285 A1 10/1993
EP 0 635 673 A1 1/1995
EP 0 780 649 A1 6/1997
FR 2 420 081 A1 10/1979
GB 1011453 12/1965
GB 2 103 354 A 2/1983
JP 3-236589 A 10/1991
JP 5-263998 A 10/1993
JP 2002-295799 A 10/2002
RU 2 180 420 C2 3/2002
RU 2 232 342 C1 7/2004
WO 94/11626 A1 5/1994
WO 97/01069 A1 1/1997
WO 98/59205 A2 12/1998
WO 00/52403 A1 9/2000
WO 03/081038 A1 10/2003
WO 03/095913 A1 11/2003
WO 03/095914 A1 11/2003
WO 2004/010480 A1 1/2004
WO 2004/109180 A1 12/2004
WO 2004/109206 A1 12/2004

(56) References Cited

FOREIGN PATENT DOCUMENTS

| | | | |
|---|---|---|---|
| WO | 2005/045337 | A1 | 5/2005 |
| WO | 2006/004723 | A1 | 1/2006 |
| WO | 2006/019900 | A1 | 2/2006 |
| WO | 2006/036441 | A1 | 4/2006 |
| WO | 2009/061777 | A1 | 5/2009 |

OTHER PUBLICATIONS

Hudson, H.M., et al., "Reducing Treating Requirements for Cryogenic NGL Recovery Plants," Proceedings of the 80th Annual Convention of the Gas Processors Association, Mar. 12, 2001, San Antonio, Texas, 15 pages.

* cited by examiner

TEMPERATURE CONTROLLED METHOD TO LIQUEFY GAS AND A PRODUCTION PLANT USING THE METHOD

FIELD OF THE INVENTION

The present invention relates to a method to liquefy natural gas from a transmission gas pipeline. The described process was developed to efficiently produce liquid natural gas (LNG).

BACKGROUND OF THE INVENTION

LNG is a natural gas that has been cooled to a cryogenic condition to condense methane, the natural gas main component. A temperature of approximately −161 C is required to produce and keep natural gas in a liquid state at standard atmospheric pressure. Liquefaction reduces the volume by approximately 600 times thus making it more economical to transport over great distances versus traditional pipelines. At present, LNG is primarily transported across continents thus making it available throughout the world. LNG is also produced in small scale liquefaction plants to supply peak saving demands, as well as to make available natural gas to regions that need it but where it is not economical or technically feasible to build pipelines.

There are differences in liquefaction selection processes for large versus small LNG plants. For large plants, the main criteria is minimization of capital cost whereas the minimization of energy consumption is left as a second objective. These two objectives can also go together; thus an optimization of the efficiency of the plant may involve a reduction in the investment of the equipment. On the other hand, a higher efficiency can result in an increase in LNG production, so the efficiency factor has a significant impact on the plant economics. In small to medium LNG plants, it is not the efficiency, but other factors such as simplicity, modularization, ease of maintenance, operation and installation that have an higher criteria when selecting a liquefaction technology. The direct consequence of these different selection criteria is that liquefaction technologies for small to medium scale applications are not the same as the ones that are used in large LNG plants.

The two main groups of liquefaction technologies are the mixed refrigerant technologies and expansion based technologies. The mixed refrigerant technologies are "condensing type" processes, where the refrigerant used for the liquefaction makes use of its latent heat of vaporization to cool the natural gas. The expansion based technologies are processes where the refrigerant is always in gas phase and only makes use of its sensible heat to cool the natural gas.

The following mixed refrigerant technologies are the most representative processes in the industry: PRICO (Poly Refrigerated Integrated Cycle Operation) is licensed by Black and Veatch and it consists of one cycle of mixed refrigerant (a mixture of methane, ethane, propane, butane, nitrogen and sometimes isopentane), the advantages claimed by the licensor are operating flexibility, modular design and reduced refrigerant inventory. The AP-M (Air Products) is licensed by APCI, is a single mixed refrigerant that is vaporized at two different levels of pressure. The dual pressure cycle is more efficient than the single pressure cycle, resulting in smaller heat exchangers and compressor. The LiMuM (Linde Multistage Mixed Refrigerant) is licensed by Linde and consists of a spiral wound heat exchanger and one 3-stage single mixed refrigeration loop for the pre-cooling, liquefaction and sub-cooling of the natural gas. This process allows for high capacity throughput. PCMR (Pre-cooled Mixed Refrigerant) is licensed by Kryopak and consists of a pre-cooling stage (ammonia or propane cycle) followed by a single mixed refrigerant cycle, where the mixed refrigerant is a mixture of nitrogen, methane, ethane, propane and butanes, this process is used primarily in small plants. OSMR (Optimized Single Mixed Refrigerant) is licensed by LNG Limited, the process is a single mixed refrigerant process complemented with a standard package ammonia absorption process. The utilization of an ammonia process improves the efficiency of the process and an increase in LNG output compared to traditional single mixed refrigerant processes. In all of the above mixed refrigerant technologies, the main differences between them are the composition of the mixed refrigerant (although the refrigerants are the same i.e.; nitrogen, methane, ethane, etc.), the metallurgy of the heat exchangers, the orientation of the equipment and the operations set points. In all the mixed refrigerants processes, the objective of innovation is to increase efficiency, reducing capital and operating costs.

The expansion based technologies have various processes based on the use of nitrogen as a refrigerant to liquefy natural gas, the $N_2$ expansion cycle. Some of these processes use a single cycle, others use a dual expansion cycle and in other cases a pre-cooling cycle is added to improve efficiency. Several licensors i.e., APCI, Hamworthy, BHP Petroleum Pty, Mustang Engineering and Kanfa Oregon offer the $N_2$ expansion cycles processes, and they differ by proprietary process arrangement. In all these processes, the cooling is provided by an external refrigeration plant using nitrogen expanders. The Niche LNG process is licensed by CB&I Lummus, consists of two cycles: one cycle uses methane as a refrigerant and the other uses nitrogen. The methane provides cooling at moderate and warm levels while the nitrogen cycle provides refrigeration at the lowest temperature level. The OCX process is licensed by Mustang Engineering and is based on the use of the inlet gas as a refrigerant in an open refrigerant cycle with turbo-expanders, there are variations such as OCX-R which adds a closed loop propane refrigerant to the OCX process and OCX-Angle which incorporates LPG recovery.

As demonstrated, presently there are many variations and processes to liquefy LNG. All of the processes operate based on the expansion of low boiling fluids be it through expanders or JT valves, be it closed or open cycle, the difference between them is in the process efficiencies which result in lower capital and operating costs per unit of LNG produced.

What is required is an alternative method to liquefy gas, such as LNG.

SUMMARY OF THE INVENTION

According to one aspect, there is provided a method for liquefying gas where a gas stream is passed through a gas expansion turbine. The method involves pre-treating the gas stream in a pre-treater to remove impurities, and then passing the gas stream through a first flow path of a first heat exchanger to lower a temperature of the gas stream. The gas stream is then passed through the gas expansion turbine to lower a pressure of the gas stream and further decrease the temperature of the gas stream. The gas stream is then passed into a primary separator to separate the gas stream into a liquid stream and a cold gas stream. The liquid stream is collected. Selected quantities of the cold gas stream are passed through a second flow path of the first heat exchanger whereby a heat exchange takes place to cool the gas stream flowing through the first flow path to maintain the temperature of the gas stream entering the gas expansion turbine at a temperature which promotes the production of liquids.

The method will hereinafter, as applied to the natural gas. The impurities removed are carbon dioxide and water. The liquids collected are natural gas liquids.

Although beneficial results may be obtained through the use of the method, as described above, greater efficiencies can be achieved through the use of a recycle stream. The recycle stream already has impurities removed. This involves a step of compressing the cold gas stream in a compressor after the cold gas stream has passed through the first heat exchanger to create a recycled gas stream and directing the recycled gas stream into the gas stream downstream of the pre-treater and upstream of the first heat exchanger.

Passing the recycled gas stream through the compressor will unavoidably raise the temperature of the recycled gas stream. It is, therefore, preferred that a step be included of passing the recycled gas stream through a first flow path of a second heat exchanger downstream of the compressor to lower the temperature of the recycled gas stream prior to the recycled gas stream being directed into the gas stream.

In accordance with the teachings of this method, a steady state will be reached in which a ratio of the recycled gas stream entering the gas stream is maintained constant.

In a variation of the method, where the liquids one wishes to collect are Liquid Natural Gas (LNG), a further step is included of mixing a slip stream of liquid natural gas (LNG) drawn from the primary separator into the gas stream via a mixer positioned downstream of the first heat exchanger and upstream of the gas expansion turbine.

In another variation of the method, a further step may be taken of passing the gas stream through a preliminary separator positioned downstream of the mixer and upstream of the gas expansion turbine to separate natural gas liquids (NGLs) from the gas stream, collecting the NGLs and directing the gas stream to the gas expansion turbine.

An advantage of the above method is that it can operate without external power inputs, resulting in substantial savings in both capital and operating costs. The above described method was developed with a view to collecting natural gas liquids and liquefying natural gas to form Liquid Natural Gas (LNG).

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

The method will now be described with reference to FIG. 1.

As set forth above, this method was developed with a view to liquefying natural gas to form Liquid Natural Gas (LNG). The description of application of the method to LNG should, therefore, be considered as an example.

Figure 1:
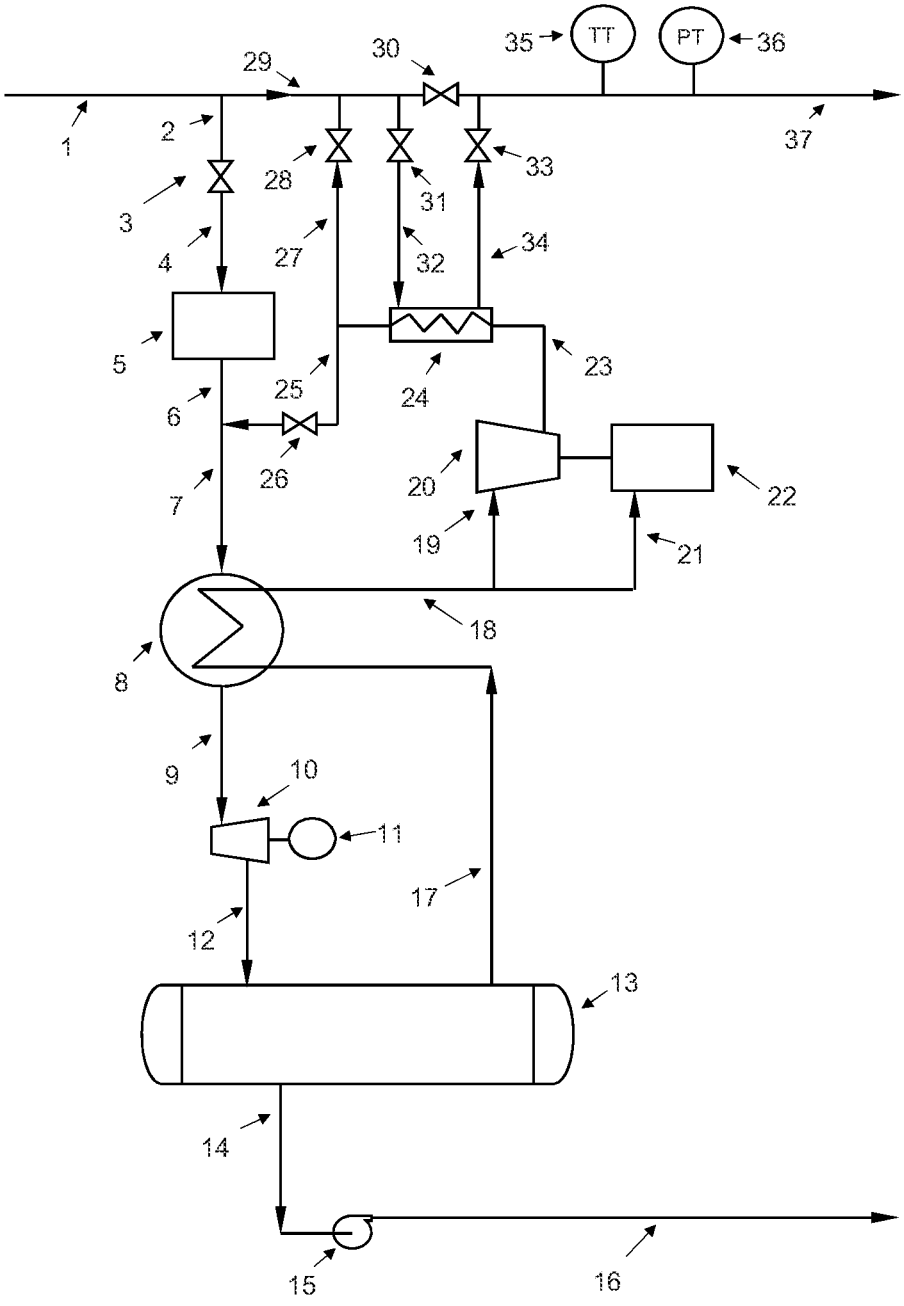
FIG. 1 is a schematic diagram of a facility equipped with a gas pre-treatment, an heat exchanger, an expander and a compressor to produce LNG.

Referring to FIG. 1, a pressurized pipeline natural gas stream 1 provides natural gas to users through line 29, valve 30 to flow distribution 37. A natural gas stream 2 is routed through flow control valve 3. The controlled flow enters the gas pre-treatment unit 5 through line 4. Pre-treatment is to remove contaminants and may not be required if the gas used is of sufficient quality. The pre-treated gas exits through line 6 and is mixed with recycled gas stream 25 through valve 26. The mixed gas stream 7 enters heat exchanger 8 where it is pre-cooled. The pressurized pre-cooled gas stream 9 enters expander 10 where the pressure is dropped resulting in a substantial temperature drop. The nearly isentropic expansion also produces torque and therefore shaft power that is converted into electricity through generator 11. The expanded gas stream 12 enters LNG receiver 13 where the liquid and vapour fractions are separated. The vapour stream 17 is routed through heat exchanger 8 to pre-cool inlet gas stream 7. The now warmed gas stream 18 enters compressor 20 through line 19 for re-compression. The compressor 20 shaft power is provided by a gas engine 22 which receives its fuel from gas line 21. The compressed recycled gas stream 23 is cooled in heat exchanger 24 before mixing it with inlet feed gas stream 6 through line 25. To prevent a buildup of nitrogen in the recycle gas stream 25, a bleeding gas stream 27 is routed to gas transmission line 29 through valve 28. The cooling of compressed recycled gas stream 23 is provided by a once through heat exchange from gas transmission line 29. The required gas coolant is routed through valve 31 and line 32 into heat exchanger 24 and the once through flow is returned to gas transmission line 29 through line 34 and valve 33. The LNG receiver 13 accumulates the LNG produced. LNG exits receiver 13 through stream 14 to supply LNG product pump 15, where it is pumped to storage through line 16.

A main feature of this invention is the simplicity of the process which eliminates the use of external refrigeration systems. Another feature of the invention is the flexibility of the process to meet various operating conditions since the ratio of LNG production is proportional to the cold vapour stream generated and recycled. The invention also provides for a significant savings in energy when compared to other processes since it uses its recycled vapour stream as the coolant medium, the process produces its own refrigeration stream. The proposed invention can be used in any LNG production plant size.

Figure 2:
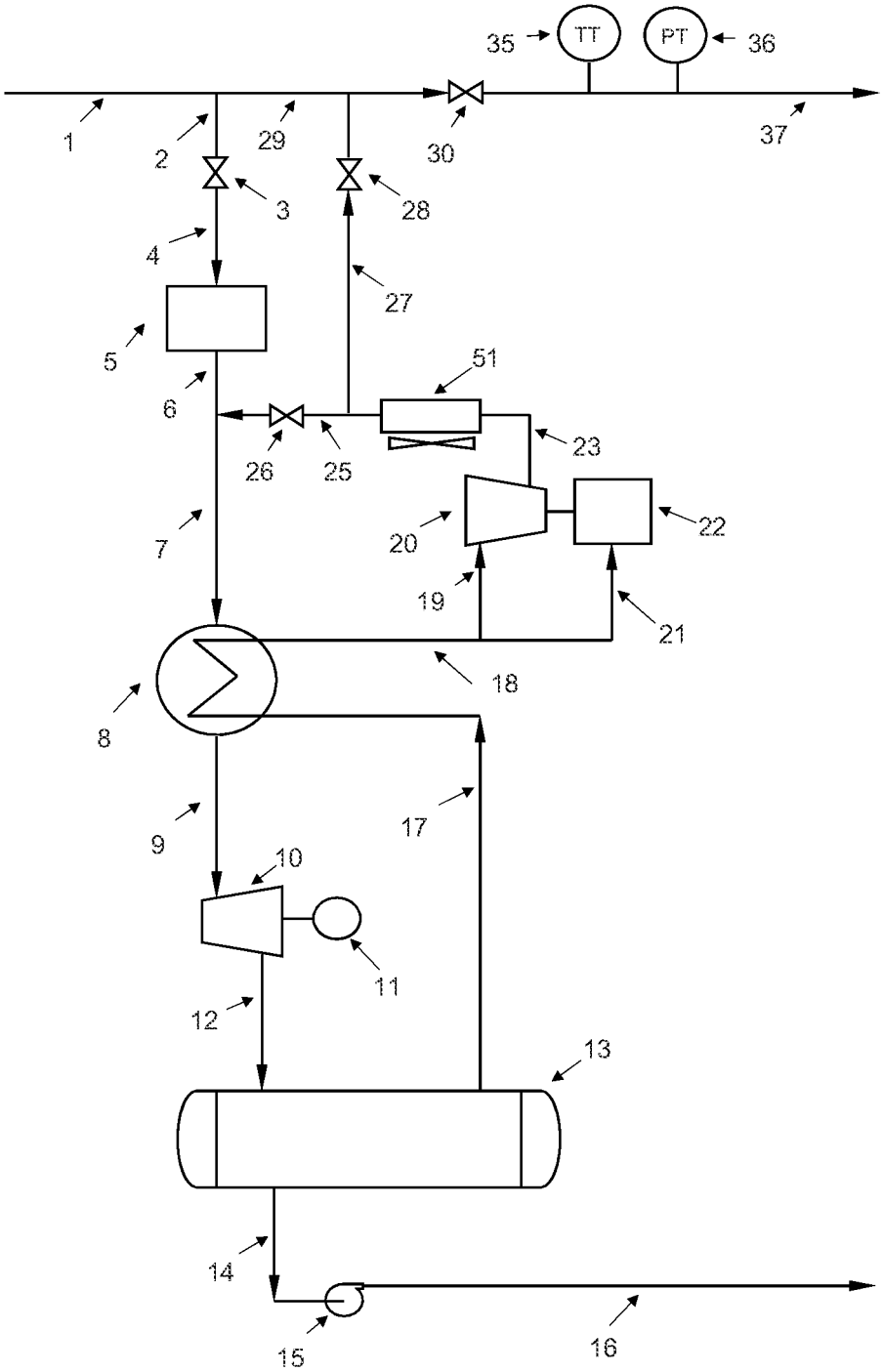
FIG. 2 is a schematic diagram of a facility equipped with an alternate cooling medium for the compression of the recycled vapour fraction.

Referring to FIG. 2, the main difference from FIG. 1 is in the heat exchanger to cool recycle stream 23. In FIG. 2, the heat exchanger 50 is an air cooling heat exchanger where ambient air is used to cool stream 23. This process orientation provides an alternative method to produce LNG at albeit less efficient than when using heat exchanger 24 as shown in FIG. 1. A pressurized pipeline natural gas stream 1 provides natural gas to users through line 29, valve 30 to flow distribution 37. A natural gas stream 2 is routed through flow control valve 3, and enters the gas pre-treatment unit 5 through line 4. The pre-treated gas exits through line 6 and is mixed with recycle gas stream 25 through valve 26. The mixed gas stream 7 enters heat exchanger 8 where it is pre-cooled. The pressurized pre-cooled gas stream 9 enters expander 10 where the pressure is dropped resulting in a substantial temperature drop. The nearly isentropic expansion also produces torque and therefore shaft power that is converted into electricity through generator 11. The expanded gas stream 12 enters LNG receiver 13 where the liquid and vapour fractions are separated. The vapour stream 17 is routed through heat exchanger 8 to pre-cool inlet gas stream 7. The now warmed gas stream 18 enters compressor 20 through line 19 for re-compression. The compressor 20 shaft power is provided by a gas engine 22 which receives its fuel from gas line 21. The compressed recycled gas stream 23 is cooled in heat exchanger 51 before mixing it with inlet feed gas stream 6 through line 25. To prevent a buildup of nitrogen in the recycle gas stream 25, a bleeding gas stream 27 is routed to gas transmission line 29 through valve 28. The cooling of compressed recycled gas stream 23 is provided by an air cooling heat exchanger 51. The LNG receiver 13 accumulates the LNG produced. LNG exits receiver 13 through stream 14 to supply LNG product pump 15, where it is pumped to storage through line 16.

Figure 3:
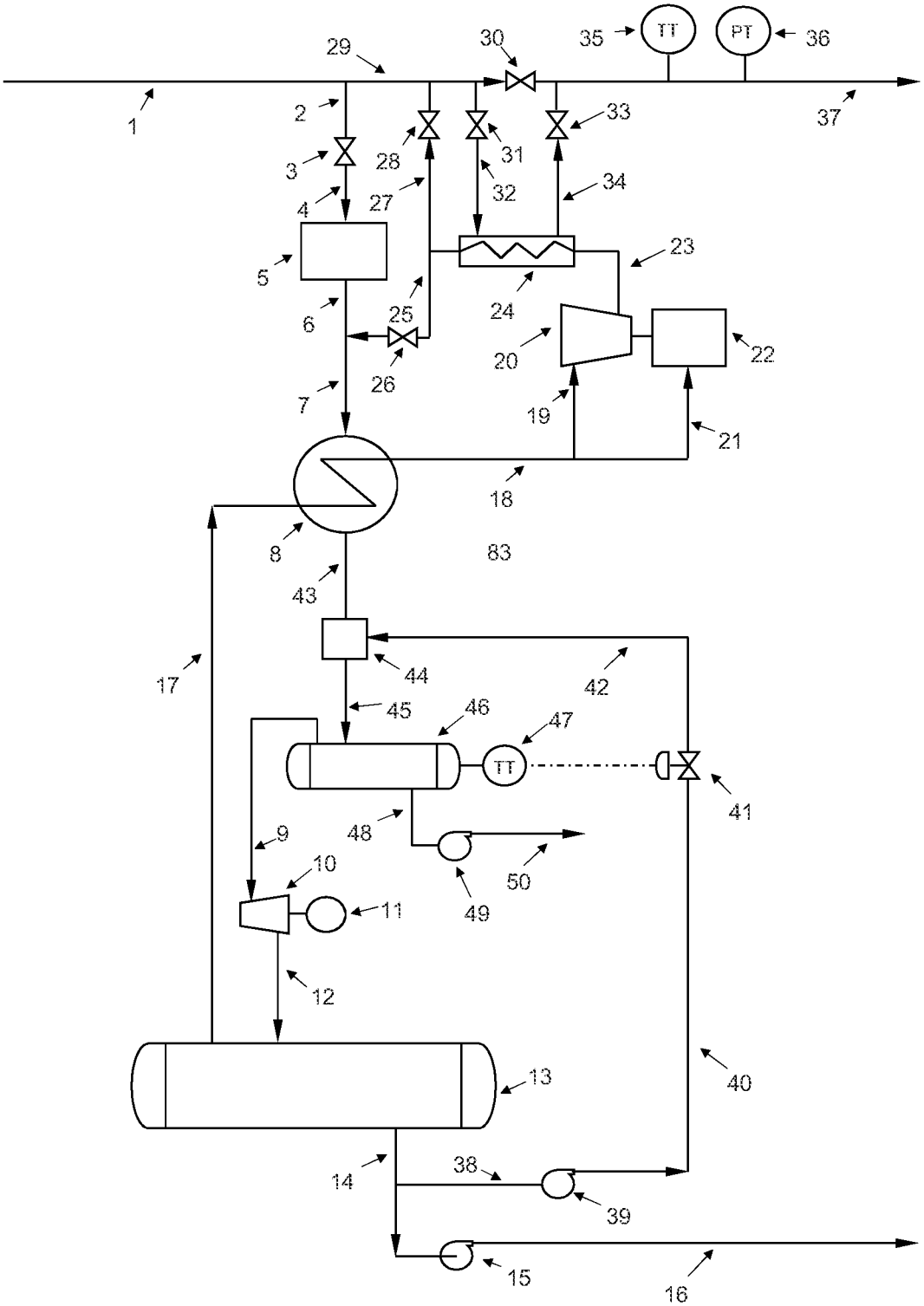
FIG. 3 is a schematic diagram of a facility equipped with the ability to recover natural gas liquids (NGLs).

Referring to FIG. 3, the main difference from FIGS. 1 and 2 is the recovery of natural gas liquids before expansion. This is achieved by circulating a portion of the generated liquid natural gas (LNG), stream 42 and mixing it in 43 with the pre-cooled gas stream 51 to meet the temperature required to condense the heavier fractions present in the natural gas stream such as; butane, propane and ethane. This process orientation provides an alternative method to produce both LNG and NGLs. A pressurized pipeline natural gas stream 1 provides natural gas to users through line 29, valve 30 to gas flow transmission line 37. A natural gas stream 2 is routed through flow control valve 3, and enters the gas pre-treatment unit 5 through line 4. The pre-treated gas exits through line 6 and is mixed with recycle gas stream 25 through valve 26, the mixed gas stream 7 enters heat exchanger 8 where it is pre-cooled. The pressurized pre-cooled gas stream 43 enters mixer 44, a LNG stream 42 is also added to mixer 44. The addition of LNG stream to mixer 44 is controlled by temperature control valve 41. The mixed stream 45, enters separator 46 where the NGLs are separated and accumulated. The NGLs exit separator 46 through line 47 to NGL pump 49 and pumped to storage through line 50. The pressurized, pre-cooled and de-liquified gas stream 9 enters expander 10 where the pressure is dropped resulting in a substantial temperature drop. The nearly isentropic expansion also produces torque and therefore shaft power that is converted into electricity through generator 11. The expanded gas stream 12 enters LNG receiver 13 where the liquid and vapour fractions are separated. The vapour stream 17 is routed through heat exchanger 8 to pre-cool inlet gas stream 7. The now warmed gas stream 18 enters compressor 20 through line 19 for re-compression. The compressor 20 shaft power is provided by a gas engine 22 which receives its fuel from gas line 21. The compressed recycled gas stream 23 is cooled in heat exchanger 24 before mixing it with inlet feed gas stream 6 through line 25 and valve 26. To prevent a buildup of nitrogen in the recycle gas stream 25, a bleeding gas stream 27 is routed to gas transmission line 29 through valve 28. The cooling of compressed recycled gas stream 23 is provided by a once through heat exchange from gas transmission line 29. The required gas coolant is routed through valve 31 and line 32 into heat exchanger 24 and the once through flow is returned to gas transmission line 29 through line 34 and valve 33.

The LNG receiver 13 accumulates the LNG produced. LNG exits receiver 13 through stream 14 to supply LNG product pump 15, where it is pumped to storage through line 16. A portion of the produced LNG is routed through line 38 to high pressure LNG pump 39. The pressurized LNG liquid stream is controlled by temperature valve 41 to a pre-set temperature through temperature transmitter 47. The controlled LNG stream 42 enters mixer 44 to cool and condense the desired natural gas liquids.

The proposed invention addresses both large and small plants in which process simplicity and ease of operation are the main components. The invention eliminates the need for refrigeration cycle plants and the use of proprietary mixed refrigerants. By simplifying the process, it reduces capital, maintenance, and operations costs.

In the preferred method, natural gas is first pre-cooled with produced cold vapor then expanded through a gas expander. The gas expander produces electricity. The expanded gas produces a vapour and a liquid stream. The vapour stream is recycled by first pre-cooling the feed gas to the expander and then recompressed, cooled and recycled. A portion of the produced LNG provides the cold energy required as a recycle stream to cool and liquefy the pre-treated natural gas stream to recover desired natural gas liquids. The proposed invention eliminates the practice and use of mixed refrigerant cycles resulting in lower capital and operating costs. The process is applicable to any LNG plant size.

VARIATIONS

It should be noted that the motive force for the compressor can be provided by an electric motor versus a gas driven engine as proposed. Moreover, the compressed vapour stream can be discharged into gas transmission line 29 rather than recycled as proposed.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the preferred embodiments set forth in the examples, but should be given a broad purposive interpretation consistent with the description as a whole.

What is claimed is:

1. A method for liquefying gas, comprising:

obtaining a gas stream from a transmission pipeline at a pipeline pressure;

pre-treating the gas stream in a pre-treater to remove impurities and produce a pre-treated gas stream;

passing the pre-treated gas stream through a first flow path of a first heat exchanger to lower a temperature of the pre-treated gas stream to produce a cooled gas stream;

passing the cooled gas stream from the first heat exchanger through a gas expansion turbine to produce an expanded gas stream by lowering a pressure of the cooled gas stream to about atmospheric pressure and further decrease the temperature of the cooled gas stream;

passing the expanded gas stream into a primary separator to separate the expanded gas stream into Liquid Natural Gas (LNG) and a cold gas stream;

collecting the LNG;

passing selective quantities of the cold gas stream through a second flow path of the first heat exchanger whereby a heat exchange takes place in the first heat exchanger to cool the pre-treated gas stream flowing through the first flow path to maintain the temperature of the cooled gas stream entering the gas expansion turbine at a temperature which promotes the production of liquids;

mixing a slip stream of the collected LNG into the cold gas stream via a mixer that is positioned downstream of the first heat exchanger and upstream of the gas expansion turbine, the slip stream causing natural gas liquids (NGLs) in the cold gas stream to condense to produce a mixed phase stream;

passing the mixed phase stream through a preliminary separator positioned downstream of the mixer and upstream of the gas expansion turbine to separate the condensed NGLs from the mixed phase stream; and directing the remaining mixed phase stream to the gas expansion turbine.

2. The method of claim 1, further comprising the step of compressing a portion of the cold gas stream to the pipeline pressure and returning the compressed cold gas stream to the transmission pipeline downstream.

* * * * *